US006877176B2

(12) United States Patent
Houghteling

(10) Patent No.: US 6,877,176 B2
(45) Date of Patent: Apr. 12, 2005

(54) INFANT SUPPORT SYSTEM

(76) Inventor: Barbara S. Houghteling, 2805 Lake Dr., Loveland, CO (US) 80538

( * ) Notice: Subject to any disclaimer, the term of this patent is extended or adjusted under 35 U.S.C. 154(b) by 52 days.

(21) Appl. No.: 10/428,245

(22) Filed: May 2, 2003

(65) Prior Publication Data

US 2005/0000022 A1 Jan. 6, 2005

(51) Int. Cl.[7] ..... A47C 20/02
(52) U.S. Cl. ..... 5/655; 5/633; 5/657
(58) Field of Search ..... 5/655, 630, 632, 5/633, 731, 732, 733, 657

(56) References Cited

U.S. PATENT DOCUMENTS

| | | | | | |
|---|---|---|---|---|---|
| 2,460,452 | A | * | 2/1949 | Hampton | 5/490 |
| 4,566,449 | A | | 1/1986 | Smith | |
| 4,780,921 | A | * | 11/1988 | Lahn et al. | 5/630 |
| 5,272,780 | A | * | 12/1993 | Clute | 5/655 |
| 5,329,934 | A | * | 7/1994 | Bowman | 5/603 |
| 5,367,730 | A | * | 11/1994 | Sher | 5/655 |
| 5,439,008 | A | * | 8/1995 | Bowman | 128/875 |
| 5,581,832 | A | * | 12/1996 | Bridley | 5/655 |
| 6,023,802 | A | | 2/2000 | King | |
| 6,292,964 | B1 | * | 9/2001 | Rose et al. | 5/630 |
| 6,421,855 | B1 | | 7/2002 | Mann | |
| 6,473,923 | B1 | * | 11/2002 | Straub | 5/655 |

OTHER PUBLICATIONS

Sleep Safely Positioner, Item No. 45004, distributed by Basic Comfort, Inc., 4100 Grape Street, Suite 2, Denver, Colorado 80216.

Baby Positioner, Item No. 45002, distributed by Basic Comfort, Inc., 4100 Grape Street, Suite 2, Denver, Colorado 80216.

Safe and Sound Sleep System, Item No. 45003, distributed by Basic Comfort, inc. 4100 Grape Street, Suite 2, Denver, Colorado 80216.

Safe Lift Deluxe Crib Wedge, Item No. SL–01, distributed by Dex Products. Inc., 602–A Stone Road, Benicia, California 94510.

* cited by examiner

*Primary Examiner*—Michael Trettel
(74) *Attorney, Agent, or Firm*—Timothy J. Martin; Michael R. Henson; Rebecca A. Gegick

(57) ABSTRACT

A cushion for supporting an infant is provided. The cushion includes a pad that may be formed of a resilient foam material. The pad includes a lower surface and an upper surface oriented at an acute angle thereto such that the upper surface is inclined relative to a support surface. The acute angle formed thereby may be between 20° and 30°. The cushion may be received within a polyester casing, but may simply include a top panel to be disposed on the pad's upper surface. The cushion includes at least one positioning member, but preferably two positioning members, with means for releasably fastening to the top panel to support the infant. Preferably, the positioning member includes a filaform strip for releasably attaching to a fabric material such as 100% polyester tricot and is formed of a resilient foam material.

45 Claims, 4 Drawing Sheets

INFANT SUPPORT SYSTEM

FIELD OF INVENTION

The present invention generally relates to support cushions. More particularly, the present invention relates to inclined support cushions for elevating an infant's head and torso while in the supine position.

BACKGROUND OF THE INVENTION

One of the strongest human instincts involves the care and nurturing of offspring. Parents provide for their children in a wide variety of ways. At a basic level, however, most parents provide their children with the necessities of food, clothing and shelter. While the needs of children last from birth through later years, the care and nurturing of newborns and young infants present special issues.

In response to these special issues, the infant/baby industry continues to grow with new and innovative products that are continuingly made available to expectant mothers and fathers for the care of their children. Presently, the infant industry offers a vast number of products ranging from bedding products, travel products, feeding products, toys, bathing and health products, clothing, and the like. More specifically, for example, numerous cushion devices, such as sleep positioners are sometimes used to create a better sleeping environment for a young child. Of these products, perhaps the most sought after items are those that improve the comfort of an infant while sleeping to both maximize their time asleep and keep them safe.

There are various kinds of infant sleep aids that accomplish these goals. For example, some products play soothing sounds to help lull an infant to sleep and may even be sound activated so that if the infant awakes, the soothing sounds may again return the infant to sleep. Sleep aids may also come in the form of sleep supports to support an infant in a particular sleeping position. For example head supports position a sleeping infant's head in a manner that helps prevent Flat Head Syndrome (Plagiocephaly).

Oftentimes, infant sleep aid products are developed in response to pediatrician recommendations. For example, some pediatricians recommend that an infant be placed either on his/her back while others recommend that the infant be placed on his/her side in an effort to reduce the risk of Sudden Infant Death Syndrome, commonly referred to as SIDS. As a result, various infant sleep positioners have been developed and typically take the form of support pillows or wedges that may be positioned about the infant to maintain the infant in the desired sleeping position.

Some pediatricians have also recommended that an infant's overall sleep may be improved if the infant's head is elevated. According to some pediatricians, elevating an infant's head makes breathing easier and improves digestion, particularly for nasal congestion and digestive problems. An example of an infant sleep aid directed toward elevating an infant's head is sometimes referred to as a crib wedge. Crib wedges may be in the form of an inclined pad are typically designed to fit within a crib. Some crib wedges are configured to fit underneath a standard crib sheet while others remain above the crib sheet similar to a pillow.

While crib wedges may improve the overall comfort of an infant while sleeping, infants tend to roll out of position due to the slope of the wedge. As a result, the infant is unable to realize the benefits of the crib wedge and, perhaps more importantly, may shift into a position that is potentially harmful to the infant's health. Accordingly, there is a need for an infant sleep aid that both elevates an infant's head and maintains the infant in a safe position while sleeping.

SUMMARY OF THE INVENTION

An object of the present invention is to provide a new and useful infant sleep aid to improve the overall comfort of an infant while sleeping.

Another object of the present invention is to provide an infant sleep aid that elevates the infant's head and torso while maintaining the infant in a safe sleeping position.

Yet another object of the present invention is to provide an infant sleep aid that has positioning support members to maintain the infant in a safe sleeping position that are adjustable to accommodate the change in the infant's size as he/she grows.

A still further object of the present invention is to provide an infant sleep aid that is portable and that may be used in a crib, cradle, infant carrier, or other support surface that is safe for a sleeping infant.

Another object of the present invention is to provide an infant sleep aid for an infant that is comfortable against the infant's skin and that maximizes airflow to prevent suffocation.

Yet another object of the present invention is to provide an infant sleep aid that is machine washable.

According to the present invention, then, an infant sleep aid is provided that is adapted to elevate the infant's head and torso as well as to maintain the infant in a safe sleeping position.

According to the present invention, then, an infant sleep system is provided that broadly includes a cushion and at least one positioning member. The cushion may include a resilient foam pad received within a casing. The foam pad is of a selected size and configuration and has a lower surface adapted to confront a support surface, and an upper surface oriented at an acute angle thereto, so as to be inclined relative to the support surface and sloping upwardly from a front end to a rear end. The acute angle formed by the upper and lower surfaces is preferably in a range between about 20° to 35°. The lower surface of the foam pad may have a geometric shape selected from the group consisting of circles, ovals, and polygons and preferably has a planar upper surface.

The foam pad may be received within a casing in a close fitted relationship, which, in an exemplary embodiment, may have a top panel joined to a bottom panel to form a casing interior. A mouth, formed by overlapping portions of the top and bottom panels, permits access to the casing interior so that the foam pad may be removed if desired. The mouth may also be associated with cooperative fasteners selected from the group consisting of hook and loop fasteners, buttons, snaps, ties, zippers, and hooks to form a closure therefore to retain the foam pad when received therein.

Preferably, the top panel of the casing includes a first panel piece disposed proximate to the front end of the foam pad. This first panel piece may be formed of a polyester material that includes a top layer that faces the exterior to form an upper surface that is polyester tricot, a bottom layer that confronts the pad that is polyester mesh, and an intermediate layer interposed therebetween that is polyester fiber. The top panel may further include a second panel piece, joined to the first panel piece to form a continuous two-piece top panel and disposed proximate to the rear end of the pad when received therein. This second panel piece is preferably formed of polyester sandwich fabric. In an alternative construction, the foam pad may simply include a top panel adapted to be disposed on at least a portion of the upper surface thereof.

The cushion may further be provided with at least one positioning member, but preferably two positioning members, with means for releasably fastening to the top panel of the casing. The means for fastening the positioning member to the top panel may be selected from the group consisting of hook and loop fasteners, buttons, snaps, ties, zippers, and hooks. Preferably, the positioning member has a filaform strip disposed thereon that can releasably attach to polyester tricot. The positioning member may be arcuate and have a cross-section of a geometric shape selected from ellipses, ellipses truncated by a plane parallel to its central axis, polygons, circles, and ovals.

In another exemplary embodiment, the infant support system may further be provided with a blanket with means to attach to the top panel of the casing.

These and other objects of the present invention will become more readily appreciated and understood from the consideration of the following detailed description of exemplary embodiments when taken together with the accompanying drawings, in which:

BRIEF DESCRIPTION OF THE DRAWINGS

FIG. 6(*b*) is a cross-sectional view of the inclined cushion taken about lines 6(*b*)—6(*b*) of FIG. 4;

DETAILED DESCRIPTION OF THE EXEMPLARY EMBODIMENTS

The present invention is directed to an infant support system to provide the infant with the benefits derived from elevating the infant's head while in a supine position while maintaining the infant safely thereon. As used herein, the term infant shall be understood to mean any child at the beginning of its life, including a newborn up through the age of a toddler. As shall be understood in view of the following description of the figures below, the infant support system contemplated by the present invention is preferably portable and constructed for use in a variety of different infant environments, such as the crib, bassinet, or simply on a safe support surface even the floor.

Figure 1:
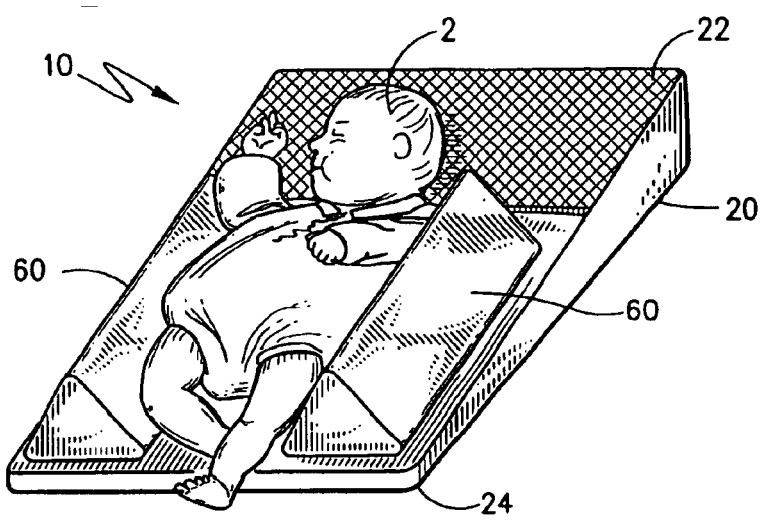
FIG. 1 is a perspective view of an infant asleep on an infant sleep aid according to the present invention.

In order to understand the unique versatility provided by the infant support system of the present invention, reference is first made to FIG. 1, which shows infant support system 10 in use by infant 2. Broadly, infant support system 10 includes inclined support cushion 20 and infant positioning members 60. As shown, cushion 20 is generally rectangular in shape and has a planar top surface 22. However, as contemplated, cushion 20 may have a variety of different geometric shapes. For example, top surface 22, and correspondingly bottom surface 24, may have a geometric shape of any regular or irregular polygon, circle, ellipse, oval, or any other desired shape. Preferably though, cushion 20 has a top surface 22 of a suitable dimension and shape that can support the infant's head an a majority of the infant's torso thereon. In addition, cushion 20 may have a concave top surface to provide a channel for the infant to lie within.

Infant positioning members 60 are generally positioned beneath the infant's arms and on either side of infant 2. Locating infant positioning members 60 beneath the infant's arms supports the infant so as to reduce the risk of the infant rolling off of the inclined pad. This is especially helpful for young infants that are acquiring mobility and are beginning to move their heads. If desired, an additional positioning member, such as a head support, may be used in combination with the support system described herein without departing from the inventive concepts contemplated by the present invention.

Figure 2:
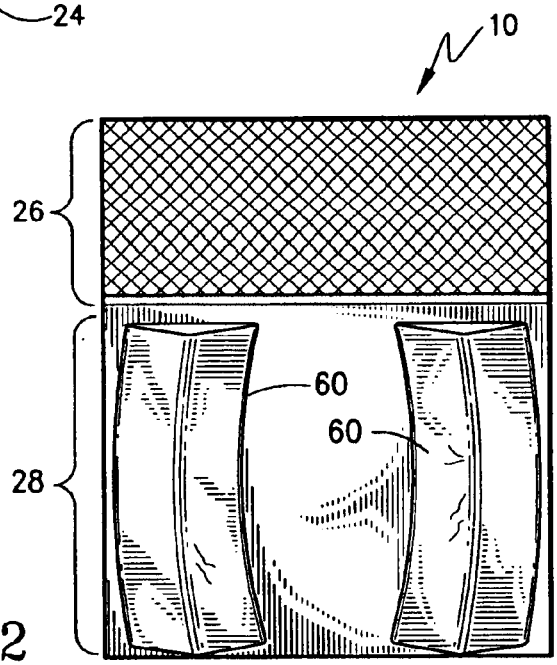
FIG. 2 is a front view in elevation of the infant sleep aid shown in FIG. 1.
Figure 3:
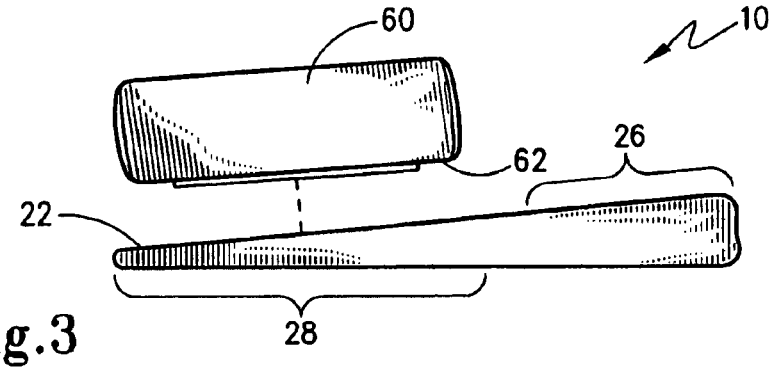
FIG. 3 is an exploded side view in elevation of an infant positioning member detached from the inclined cushion.

With reference to FIGS. 2 and 3, cushion 20 can generally be divided into two sections, first section 26 and second section 28. As perhaps best shown in FIG. 3, first section 26 has a general thickness that is greater than the thickness of section 28 and thus forms the desired location for the infant's head and because it is elevated. Positioning members 60, on the other hand, are preferably located in section 28 of cushion 20 and include a bottom surface 62 adapted to be seated on top surface 22 of cushion 20. Positioning members 60 are shown to have a slight arcuate shape, which offers comfortable support for the infant lying therebetween. Of course, as should be understood, the positioning members can accomplish adequate support for the infant without being arcuate.

It is desirable that the positioning members be detachable from cushion 20 so that they may be arranged in any desired orientation relative to the top surface. Accordingly, positioning members 60 are not limited to being aligned parallel to one another, as shown in FIG. 2, but may also be positioned at any desired angle with respect to one another on top surface 22. For example, positioning members 60 could be positioned to form a V-shape if so desired. The mechanism by which the positioning members may be releasably detached to top surface 22 will be described in further detail below.

Figure 4:
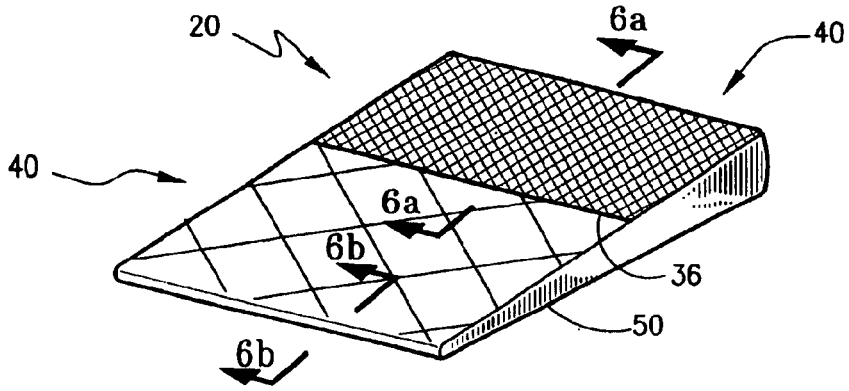
FIG. 4 is a perspective view of the inclined cushion shown without the infant positioning members.
Figure 5:
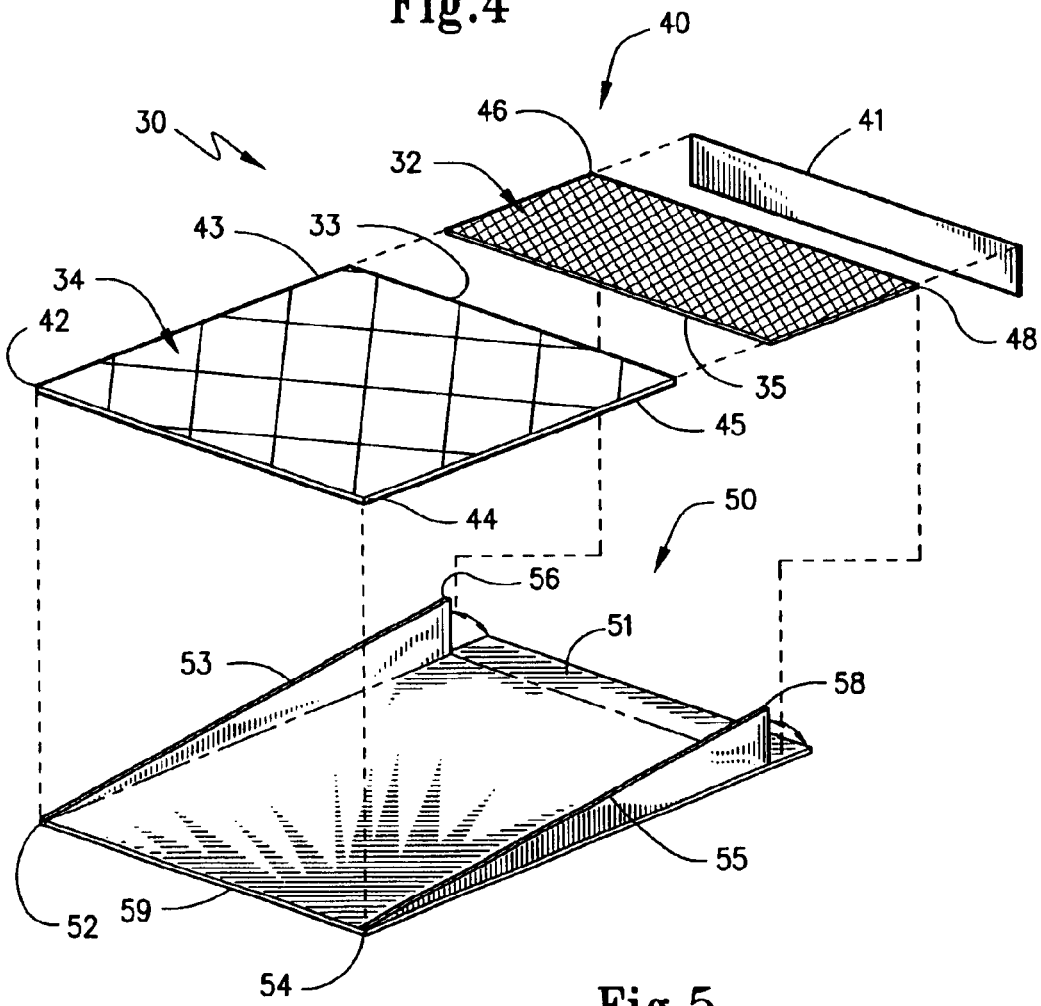
FIG. 5 is an exploded perspective view of the casing that receives the inclined pad therein.
Figure 6A:
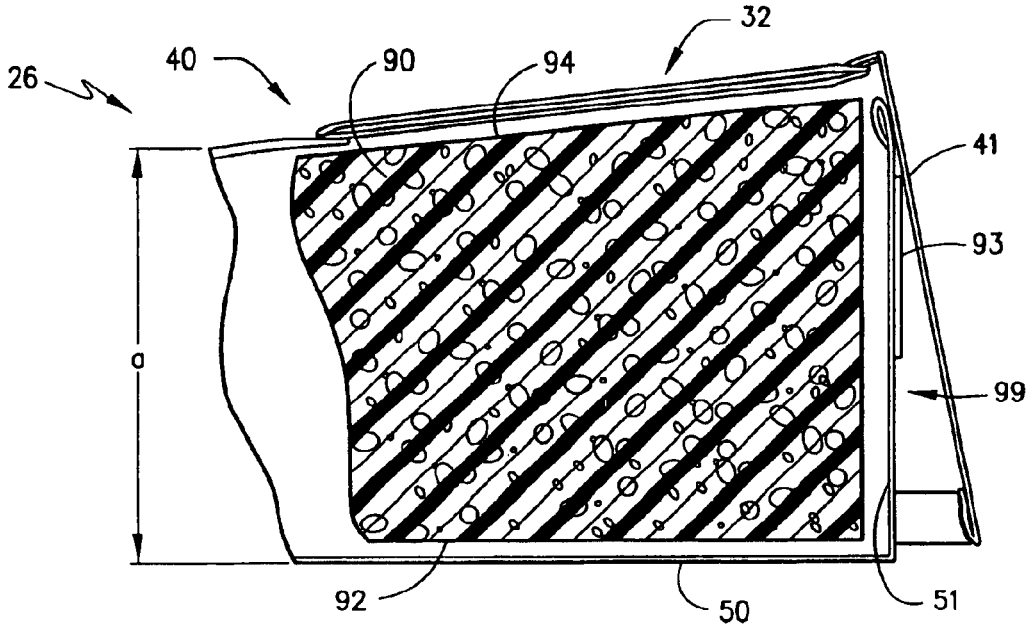
FIG. 6(*a*) is a cross-sectional view of the inclined cushion taken about lines 6(*a*)—6(*a*) of FIG. 4.
Figure 6B:
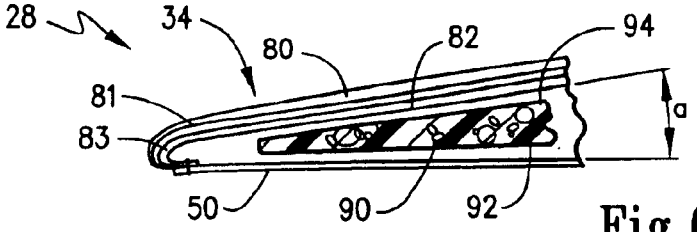

Turning now to FIGS. 4–6(*a*) and (*b*), support cushion 20 is generally constructed of a casing 30, which receives a resilient foam pad 90 in a close-fitted relationship. Casing 30 may be constructed of various panel sections including head panel 32 and foot panel 34. Head panel 32 and foot panel 34 have respective confronting edges 33 and 35, which are stitched, or otherwise joined together to form junction 36. In this way, head panel 32 and foot panel 34 form a continuous, two-piece top panel 40. Top panel 40 may be joined to a one-piece bottom panel 50 about the majority of its peripheral margin. More specifically, as shown in FIG. 5, corners 42 and 44 of top panel 40 are aligned with corners 52 and 54 of bottom panel 50, while corners 46 and 48 of top panel 40 are aligned with corners 56 and 58 of bottom panel 50. In this way, top panel 40 is stitched, or otherwise joined along sides 43 and 45 and end 49 to bottom panel sides 53 and 55, and end 59 respectively.

Top panel 40 and bottom panel 50 may further include respective overhanging margins 41 and 51, which are not stitched together, but rather overlap with one another to form a mouth 99, which is shown in FIG. 6(*a*). Mouth 99 permits access into the interior of the casing 30 so that foam pad 90 may be removed from the casing if desired.

Casing 30 is not limited to the construction described above, but rather may have a variety of different constructions that allow for a close-fitted relationship around the foam pad. For example, top panel 40 may be a one-piece construction that is joined to a two-piece bottom panel. Alternatively, the casing may be formed of one folded panel piece, that folds about the foam pad. Further, as is also contemplated by the present invention, foam pad 90 need not include casing 30, but may simply include a top panel adapted to be disposed on a portion of upper surface 94. In this way, a bottom panel, casing interior, and casing mouth would not be necessary.

Now that the construction of casing 30 has been described in some general detail, a more detailed look at its construction in association with foam pad 90 can now be explained with reference FIGS. 6(*a*) and 6(*b*). Turning first to FIG. 6(*a*), foam pad 90 has a bottom surface 92 and top surface 94. Bottom surface 92 is adapted to be supported by any suitable support surface such as a table, crib, bassinette, and the like while top surface 94 is adapted to support the infant thereon. Also, as shown, top surface 94 is oriented at an acute angle "a" relative to bottom surface 92. Preferably, acute angle "a" is an angle large enough to elevate the infant's head and at least a portion of the torso so as to derive the benefits therefrom, but not so large that it poses a risk to the infant, especially a newborn infant. Preferably, acute angle "a" is in a range between about 20° and 35°. Foam pad 90 may be made of any resilient or compressible material known in the art, but is preferably memory foam.

With continued reference to FIG. 6(*a*), it is preferred that casing 30 include a head panel 32, overhanging margins 41 and 51, and bottom panel 50 may be formed from any suitable material appropriate for lying an infant thereon, such as, for example, silk, polyester, cotton, cotton blends, synthetics, synthetic blends, and the like. With respect to head panel 32, it is desirable that the fabric material be one that enhances the breathability for the infant, since head panel 32 serves as the general location for the infant's head (as shown in FIG. 1). For example, head panel 32 may be 100% polyester sandwich fabric. Overhanging margins 41 and 51, as well as bottom panel 50 may also be formed of 100% polyester sandwich fabric, but are preferably a fabric that is 50% cotton and 50% polyester.

As described above, foam pad 90 may be removed from casing 30 via mouth 99 that is formed by overhanging margins 41 and 51 of top panel 40 and bottom panel 50 respectively. Mouth 99 may be releasably fastened to secure foam pad 90 therein by any suitable fastening means such as, a zipper, button, snaps, ties, as well as cooperating hook and loop fasteners. Preferably, as shown in FIG. 6(*a*), bottom panel 51 includes a filaform strip 93 which may be releasably secured to overhanging margin 41. Filaform strip 93 may either attach to a loop fastening strip, if provided, or simply to the fabric of panel 41 itself. Preferably, the fabric of panel 41 is 50% cotton and 50% polyester, which cooperates with filaform strip 93.

Turning now to FIG. 6(*b*), the cross-section of cushion section 28 is shown again illustrating that casing 30 envelopes foam pad 90 in a close fitting relationship. Similarly to cushion section 26 described in reference to FIG. 6(*a*), the top surface 94 extends at an acute angle a relative to bottom surface 92 of the foam pad at acute angle "a". Further, foot panel 34 may be formed from any suitable material appropriate for lying an infant thereon, such as, for example, silk, polyester, cotton, cotton blends, synthetics, synthetic blends, and the like. Further, since foot panel 34 is generally associated with the main body portion of the infant (as shown in FIG. 1), it may be constructed of a hydrophobic material. However, it is desirable that that foot panel 34 be formed of a polyester material such as 100% polyester tricot. Further, it is desired that foot panel 34 be formed as a tri-layer polyester construction that includes an outer layer 80 that is 100% polyester tricot, a bottom layer 82, that is 100% polyester fine mesh, and an intermediate later 81 that is 100% polyester fiber.

Figure 7:
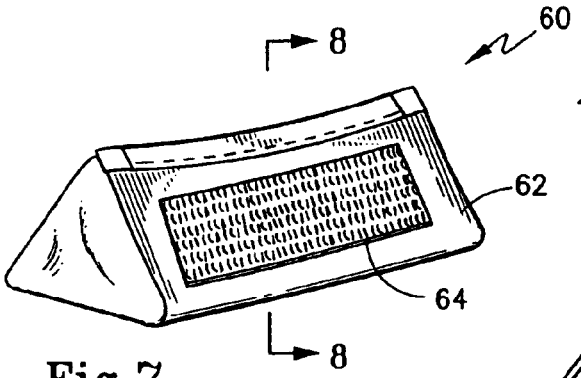
FIG. 7 is a perspective view of the infant positioning member that is supporting the sleeping infant shown in FIG. 1 showing the bottom panel thereof.
Figure 8:
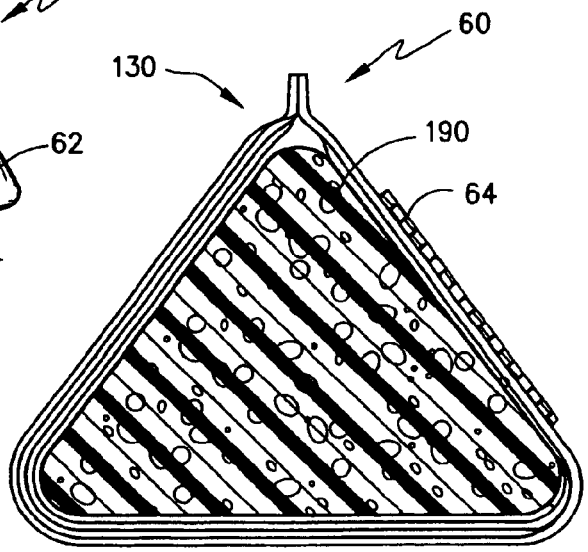
FIG. 8 is cross-sectional view of the infant positioning member taken about lines 8—8 of FIG. 7.

Turning now to FIGS. 7 and 8, a more detailed description of the positioning member according to the present invention may be described. As shown, positioning member 60 is triangular in cross-section and includes a foam piece 190 enveloped by casing 130. Foam piece 190 may be formed of any suitable resilient foam material such as the memory foam which forms the foam material of the cushion.

Positioning member 60 preferably has a flat bottom surface 62 that serves as a location for a means of fastening the positioning member to the cushion. Such fastening means may include zippers, buttons, snaps, ties, and the like. Alternatively, it may be desirable to provide a positioning member without any fastening means to cooperate with the cushion.

Preferably, though, and as shown in FIGS. 7 and 8, positioning member 60 is provided with a filaform strip 64, which is adapted to releasably attach to a cooperative loop fastener, such as the 100% tricot polyester material described in reference to outer layer 80 in FIG. 6(*b*). Alternatively, filaform strip 64 may cooperate with a separate loop strip that may be provided on the cushion. The casing 130 of positioning member 60 may be again of any suitable fabric material that is comfortable against an infant's skin such as, silk, polyester, cotton, cotton blends, synthetics, synthetic blends, and the like. Preferably though, casing 130 is constructed of 100% polyester sandwich material, such as that described above with respect to head panel 32 to provide improved breathability.

Figure 9:
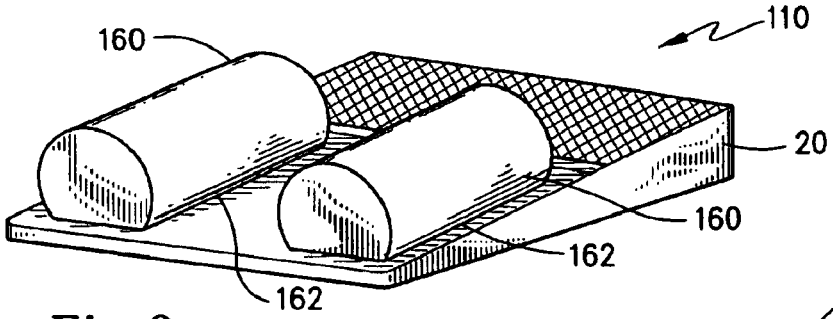
FIG. 9 is a perspective view of the inclined cushion with an alternative infant positioning member construction.
Figure 10:
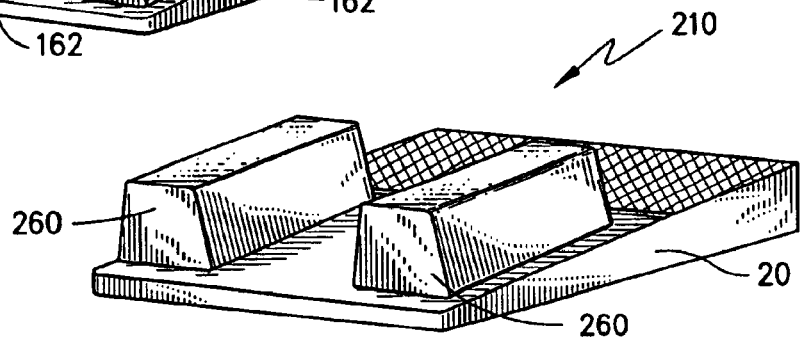
FIG. 10 is a perspective view of the inclined support cushion in use with another infant positioning member construction.

The present invention also contemplates the use of positioning members having different geometric shapes than that shown in FIGS. 7 and 8. For example, positioning member 160, shown in FIG. 9, has a cross-sectional geometric shape of an ellipse truncated by a plane that is parallel to the bottom surface 162. Alternatively, positioning members 260, as shown in FIG. 10 may have a cross-sectional geometric shape be constructed as a truncated prism. As should be understood, any variety of shapes of positioning members may be used such that they provide support suitable to maintain an infant in a supine position. Accordingly, the present invention contemplates positioning members that have a geometric shape that is circular, ovular, elliptical, and polygonal in cross-section. Further, it is not required that the positioning members have a flat base to be useful to support the infant.

Figure 11:
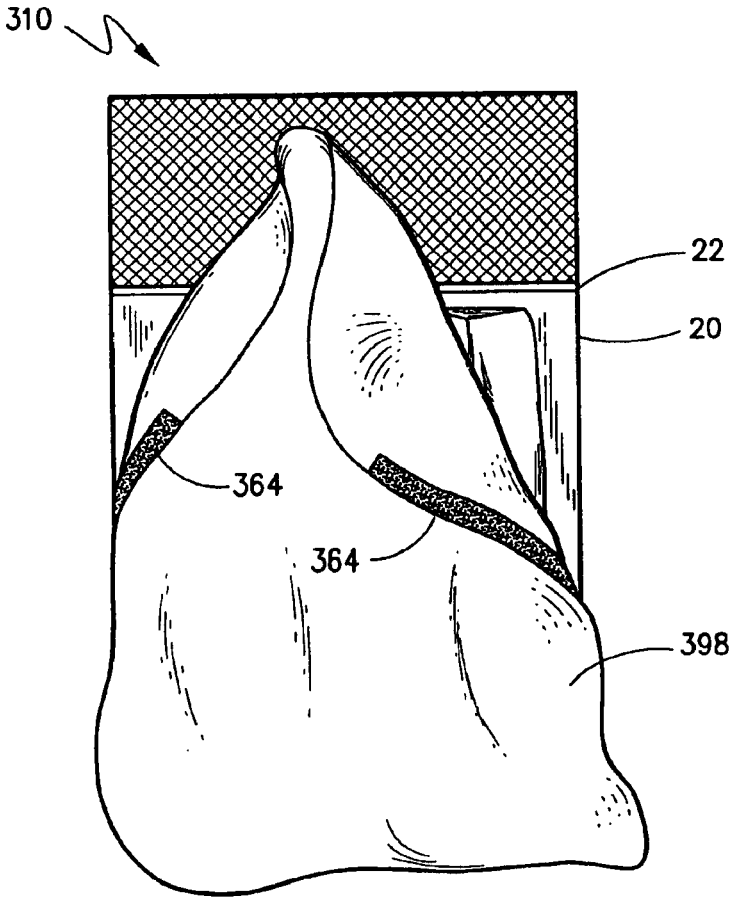
FIG. 11 is a front view in elevation of the infant sleep aid according to the present invention in use with a detachable blanket.

Finally, the infant support system of the present invention may further include a cooperating blanket such as blanket 398 shown in FIG. 11. Blanket 398, similar to the positioning members described above, may include means by which it may be fastened to support cushion 20. For example, blanket 398 may be constructed so as to have filaform strips 364 that may either adhere cooperatively to a loop fastening strip on cushion 20 or, as described above, may be adapted to releasably affix to a fabric material of the top surface 22 of the cushion, such as 100% polyester tricot.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A cushion for supporting an infant upon a support surface, comprising:

(A) a pad of selected size and configuration and having a lower surface adapted to confront the support surface and an upper surface opposite the lower surface and oriented at an acute angle from a first end portion to a second end portion such that the upper surface is inclined relative to the support surface along an axis extending between said first and second end portions, said pad having a width extending transversely of said axis;

(B) a top panel adapted to be disposed on at least a portion of the upper surface of said pad, said top panel including a first section extending transversely of said axis for a majority of the width of said pad and formed of a first material and a second section extending transversely of said axis for a majority of the width of said pad and formed of a second material that is different from the first material;

(C) at least one infant positioning member of a selected size and configuration adapted to be supported by the upper surface of said pad;

(D) means for releasably fastening said positioning member to the top panel of said casing.

2. A cushion according to claim 1 wherein said pad is constructed of foam.

3. A cushion according to claim 1 wherein the acute angle is in a range between about 20° to 35°.

4. A cushion according to claim 1 wherein the lower surface of said base and the bottom panel of said casing each have a geometric shape selected from the group consisting of circles, ovals, and polygons.

5. A cushion according to claim 1 wherein the upper surface of said pad is planar.

6. A cushion according to claim 1 wherein the first section of said top panel is formed of a polyester material.

7. A cushion according to claim 6 wherein said polyester material includes (A) a top layer that faces the exterior to form an upper surface for said casing that is polyester tricot;

(B) a bottom layer that confronts said pad that is polyester mesh; and (C) an intermediate layer interposed between said top layer and said bottom layer that is polyester fiber.

8. A cushion according to claim 1 wherein said second section of said top panel is constructed of polyester sandwich fabric.

9. A cushion according to claim 1 wherein said positioning member has a cross section of a geometric shape selected from ellipses, ellipses truncated by a plane parallel to the central axis thereof, polygons, circles, and ovals.

10. A cushion according to claim 1 including two infant positioning members spaced apart a selected distance from one another.

11. A cushion according to claim 1 wherein said means for fastening said positioning member to the top panel of said casing is selected from the group consisting of hook and loop fasteners, buttons, snaps, ties, zippers, and hooks.

12. A cushion according to claim 1 including a filaform strip disposed on a portion of said positioning member and adapted to releasably secure to polyester fabric.

13. A cushion for supporting an infant upon a support surface, comprising:

(A) a pad of selected size and configuration and having a lower surface adapted to confront the support surface and an upper surface opposite the first surface oriented at an acute angle thereto and sloping upwardly from a front end to a rear end such that the upper surface is inclined relative to the support surface, said pad formed of a resilient foam;

(B) a casing sized and adapted to receive said inclined pad therein, said casing including (1) a top panel formed of a first panel piece and a second panel piece, said first and second panel pieces further including respective confronting edges that are joined together so that said top panel is a continuous two-piece construction;

(2) a bottom panel joined to said top panel around a periphery thereof to form a casing interior; and (3) a mouth to permit access to the casing interior;

(C) two infant positioning members of a selected size and configuration adapted to be supported by said pad; and (D) means for releasably fastening a portion of each of said positioning member to said first panel piece at a selected orientation relative to the upper surface of said pad.

14. A cushion according to claim 13 wherein the acute angle is in a range between about 20° to 35°.

15. A cushion according to claim 13 wherein said first panel piece is disposed proximate to the front end of said pad when received in said casing and is formed of a polyester fabric.

16. A cushion according to claim 15 wherein the polyester fabric of said first panel piece includes (A) a top layer that faces the exterior to form an upper surface for said casing that is polyester tricot;

(B) a bottom layer that confronts said pad that is polyester mesh; and (C) an intermediate layer interposed between said top layer and said bottom layer that is polyester fiber.

17. A cushion according to claim 13 wherein said second panel piece is disposed proximate to the rear end of said pad when received in said casing and is formed of polyester sandwich fabric.

18. A cushion according to claim 13 wherein said top and bottom panels each have a respective margin which overlap with one another to form the mouth of said casing.

19. A cushion according to claim 18 the overlapping margins of said top and bottom panels are formed of a fabric material selected from the group consisting of polyester, cotton, cotton/synthetic blend, and synthetic blend.

20. A cushion according to claim 13 including cooperative fasteners associated with the mouth of said casing to form a closure that is operative to releasably close the mouth thereby to retain the pad when received therein.

21. A cushion according to claim 20 wherein said fasteners are selected from a group consisting of hook and loop fasteners, buttons, snaps, ties, zippers, and hooks.

22. A cushion according to claim 13 wherein said positioning member has a cross section of a geometric shape selected from ellipses, ellipses truncated by a plane parallel to the central axis thereof, polygons, circles, and ovals.

23. A cushion according to claim 13 wherein said means for fastening said positioning members to the top panel of said casing is selected from the group consisting of hook and loop fasteners, buttons, snaps, ties, zippers, and hooks.

24. A cushion according to claim 13 including a filaform fastening strip disposed on a portion of each said positioning member and adapted to releasably secure to polyester tricot.

25. In an infant support system including an inclined pad adapted to elevate an infant's head and torso while in the supine position, the improvement comprising:

(A) a casing sized and adapted to receive the pad therein, including (1) a top panel joined to a bottom panel around a periphery thereof to form a casing interior wherein a portion of said top panel is formed of a first material and said bottom panel is formed of a second material that is different from said first material; and (2) a mouth to permit access to the casing interior;

(B) two infant positioning members of a selected size and configuration adapted to be supported by the pad; and (C) means for releasably fastening said infant positioning members to the first material of said top panel.

26. An infant support system according to claim 25 wherein the first material is polyester fabric.

27. An infant support system according to claim 26 wherein the polyester fabric includes (A) a top layer that faces the exterior to form an upper surface for said casing that is polyester tricot;

(B) a bottom layer that confronts said pad that is polyester mesh; and (C) an intermediate layer interposed between said top layer and said bottom layer that is polyester fiber.

28. An infant support system according to claim 26 wherein said polyester fabric is polyester sandwich fabric.

29. An infant support system according to claim 25 wherein said positioning members have a cross section of a geometric shape selected from ellipses, ellipses truncated by a plane parallel to the central axis thereof, polygons, circles, and ovals.

30. An infant support system according to claim 25 wherein said positioning members are arcuate.

31. An infant support system according to claim 25 wherein said positioning members are constructed of a resilient foam material encased in a polyester sandwich fabric.

32. An infant support system according to claim 25 wherein said means for fastening said positioning members to the top panel of said casing is selected from the group consisting of hook and loop fasteners, buttons, snaps, ties, zippers, and hooks.

33. An infant support system according to claim 25 including a filaform fastening strip disposed on a portion of each said positioning member and adapted to releasably secure to polyester tricot.

34. An infant support system according to claim 25 including a blanket.

35. An infant support system according to claim 34 including means for releasably attaching said blanket to said casing.

36. A cushion for supporting an infant upon a support surface, comprising:

(A) a pad of selected size and configuration and having a lower surface adapted to confront the support surface and an upper surface opposite the lower surface and oriented at an acute angle from a first end portion to a second end portion such that the upper surface is inclined relative to the support surface along an axis extending between said first and second end portions, said pad having a width extending transversely of said axis;

(B) a cover including a top panel adapted to be disposed on the upper surface of said pad;

(C) a pair of infant positioning members each of a selected size and configuration adapted to be supported by the upper surface of said pad; and (D) means for releasably fastening said positioning members to the top panel whereby said positioning members may be selectively spaced apart at different selected distances laterally from one another in a direction transverse to said axis across a majority of the width of said pad.

37. A cushion according to claim 36 wherein the acute angle is in a range between about 20° to 35°.

38. A cushion according to claim 36 wherein said means for releasably fastening said positioning members to the top panel of said cover is selected from the group consisting of hook and loop fasteners, buttons, snaps, ties, zippers, and hooks.

39. An infant support system according to claim 36 wherein a portion of said top panel is constructed of a polyester fabric and wherein said means for releasably fastening said positioning members is a hook fastening strip.

40. An infant support system according to claim 39 including a plurality of loop fastening strips disposed on said top panel and wherein said means for releasably fastening said positioning members is a hook fastening strip.

41. An infant support system for elevating an infant's head and torso while in the supine position, comprising:

(A) an inclined pad, including (1) a first end having a first thickness;

(2) a second end having a second thickness that is greater than the first thickness;

(3) a lower surface extending between said first and second ends and adapted to confront the support surface;

(4) an upper surface in spaced relation to said lower surface and oriented at an acute angle thereto, said upper surface extending between said first and second ends along an axis, said pad having a width extending transversely of said axis;

(B) a top panel extending transversely of said axis for a majority of the width of said pad in confronting relation with said upper surface; and (C) a pair of infant positioning members each of a selected size and configuration and each including a fastener adapted to releasably secure said positioning members to said top panel so as to be selectively oriented at desired locations across a majority of the width of said pad.

42. An infant support system according to claim 41 wherein the acute angle is in a range between about 20° to 35°.

43. An infant support system according to claim 41 wherein said top panel is constructed of a polyester fabric and each said fastener is adapted to releasabiy secure said positioning members to said polyester fabric.

44. An infant support system according to claim 41 including a plurality of loop fastening strips disposed on said top panel and wherein said infant positioning member fasteners are hook fasteners.

45. An infant support system for elevating an infant's head and torso while in the supine position, comprising:

(A) an inclined pad, including (1) a first end having a first thickness;

(2) a second end having a second thickness that is greater than the first thickness;

(3) a lower surface extending between said first and second ends and adapted to confront the support surface;

(4) an upper surface in spaced relation to said lower surface and oriented at an acute angle thereto, said upper surface extending between said first and second ends along an axis, said pad having a width extending transversely of said axis;

(B) a cover including a top panel extending transversely of said axis for a majority of the width of said pad and in confronting relation with said upper surface; and (C) an infant positioning member of a selected size and configuration and including a fastener adapted to releasably secure said positioning member to said top panel so as to be selectively oriented at desired locations across a majority of the width of said pad.

* * * * *